US005645511A

United States Patent [19]

Le Roux et al.

[11] Patent Number: 5,645,511

[45] Date of Patent: Jul. 8, 1997

[54] EXERCISE APPARATUS

[75] Inventors: Philippe A. Le Roux, Northampton; David A. Edgerley, London, both of England

[73] Assignee: Green Journal Ltd., Northampton, England

[21] Appl. No.: 991,460

[22] Filed: Dec. 16, 1992

Related U.S. Application Data

[63] Continuation-in-part of Ser. No. 886,699, May 21, 1992, Pat. No. Des. 353,636.

[30] Foreign Application Priority Data

| | | | |
|---|---|---|---|
| Nov. 21, 1991 | [GB] | United Kingdom | 2019088 |
| Nov. 21, 1991 | [GB] | United Kingdom | 2019089 |
| Nov. 21, 1991 | [GB] | United Kingdom | 9124740 |

[51] Int. Cl.[6] ..... A03B 21/012

[52] U.S. Cl. ..... 482/52; 482/142

[58] Field of Search ..... 482/51, 52, 53, 482/148, DIG. 9, 142; 182/194; 108/19

[56] References Cited

U.S. PATENT DOCUMENTS

| | | | |
|---|---|---|---|
| D. 330,234 | 10/1992 | Saunders | 482/52 |
| 3,907,068 | 9/1975 | Ulerich | 182/194 |
| 4,106,413 | 8/1978 | Hoaglund | 108/19 |
| 4,678,234 | 7/1987 | Wilson | 297/439 |
| 5,108,089 | 4/1992 | Wilkinson | 482/52 |
| 5,184,987 | 2/1993 | Wilkinson | 482/52 |

FOREIGN PATENT DOCUMENTS

| | | | |
|---|---|---|---|
| 901614 | 5/1972 | Canada | 272/30 |
| 1079004 | 8/1967 | United Kingdom | A47C 9/12 |
| WO91/04767 | 4/1991 | WIPO | A63B 1/00 |
| WO92/06744 | 4/1992 | WIPO | A63B 5/00 |

*Primary Examiner*—Stephen R. Crow

[57] ABSTRACT

An exercise apparatus is disclosed having a bridge and two adjustably connectable support elements. The bridge and support elements are configured so that the support elements can securely engage the bridge in a locking fashion at three different relative positions, thus supporting the bridge at different heights.

13 Claims, 6 Drawing Sheets

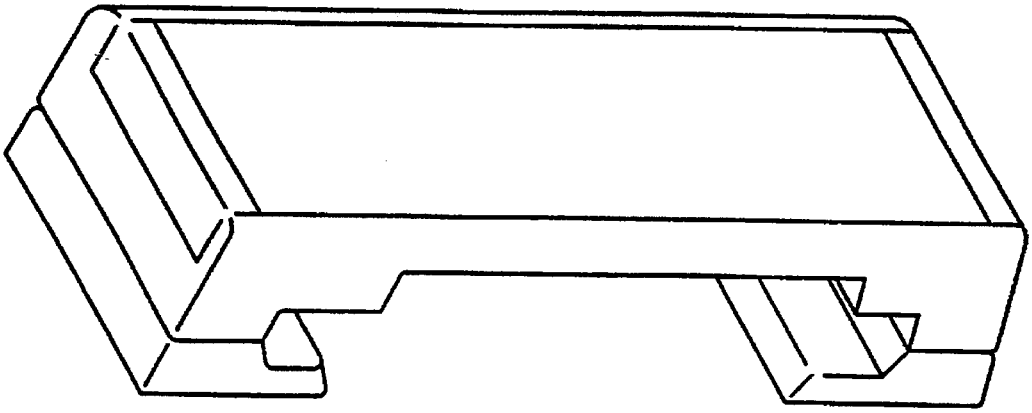
FIG. 3
FIG. 4
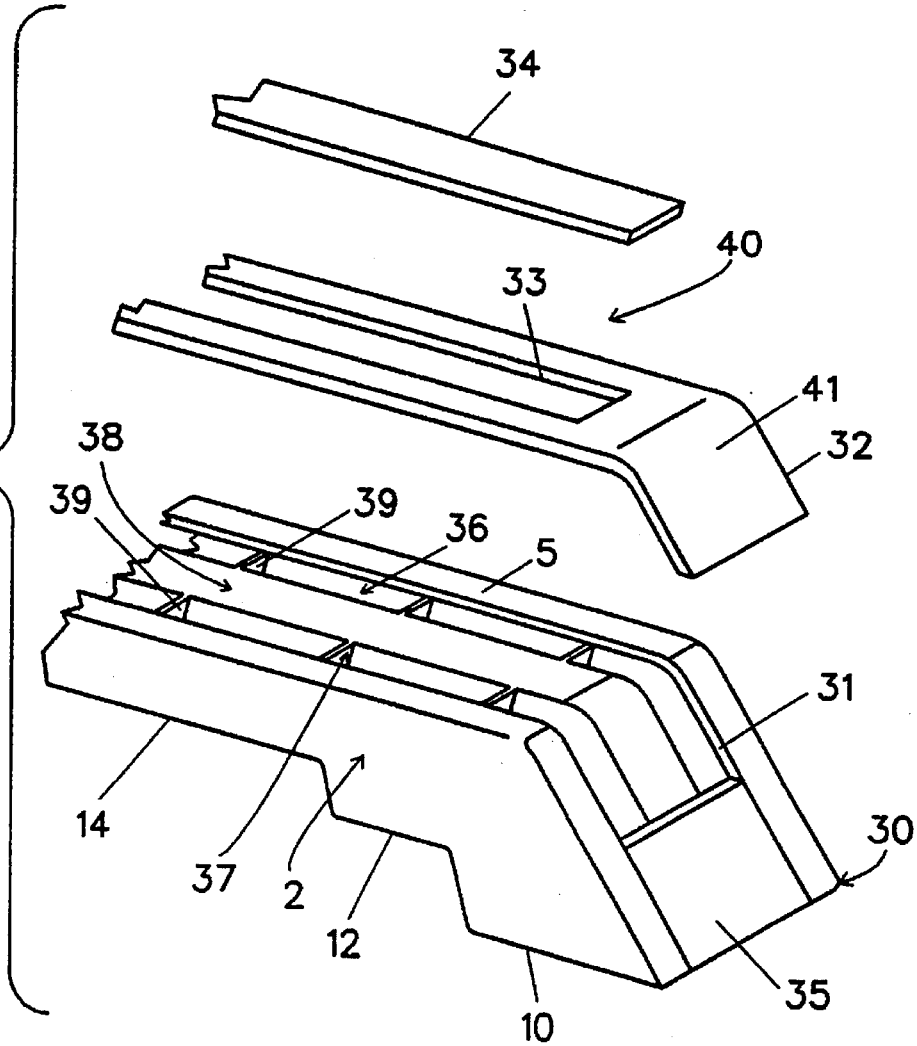

EXERCISE APPARATUS

This application is a continuation in part of application Ser. No. 886,699, filed May 21, 1992, now U.S. Pat. No. Des. 353,636.

BACKGROUND OF THE INVENTION

The present invention relates to an exercise apparatus and more particularly relates to a step apparatus for use when carrying out stepping exercises.

It has long been known that stepping up and down, so that the body is alternately raised and lowered, is an excellent form of aerobic exercise. In the past such stepping exercises have been carried out using benches or the like. The present invention, in one aspect, seeks to provide an apparatus for use in carrying out stepping exercises.

When interconnecting two elements which are formed of a molded plastics material, it is desirable to utilize connectors which are spaced apart. However, when elements are molded of a plastics material different examples of the element may have different dimensions due to, for example, slight alterations in various parameters during the molding process. These parameters may include the temperature of the mold and the precise composition of the plastic. Thus, if connectors are provided which require to be accurately aligned, it is frequently impracticable to have such connectors spaced apart by a significant distance. However, if the connectors are close together, two elements of plastics material cannot be securely fastened together. Thus, in another aspect, the invention seeks to provide a connector that may be utilized to interconnect two elements, where, due to the nature of the elements, the connector components on the two elements may not be precisely aligned.

SUMMARY OF THE INVENTION

According to one aspect of this invention, there is provided an exercise apparatus, the apparatus comprising a bridge element, the bridge element being of elongate form and having two end regions, and two support elements, each support element being adapted to engage a respective end region of the bridge, the bridge and the support elements being so configured that the support elements can engage the bridge in different relative positions, thus supporting the bridge at different heights.

Preferably, the support elements can engage the bridge in three different positions, thus supporting the bridge at three different heights.

Conveniently, each support element comprises means defining a base to engage the ground and an upper surface having two portions, namely a lower portion and an upper portion, each end of the bridge having an under surface defining at least two levels which are spaced apart vertically, and adapted selectively to engage said portions of the upper surface of the support element.

Advantageously, connector means are provided for releasably connecting each support to the bridge, the connector means being located on the uppermost part of the upper surface of each support.

Conveniently, the connector means comprise cooperating elements present on the bridge and on the support, the elements on the support comprising projections, each projection having connector means adapted to engage cooperating surfaces provided on the bridge.

Preferably, the cooperating surfaces on the bridge comprise inclined surfaces which bound apertures formed in a recess formed in the under surface of the bridge.

Conveniently, each connector means comprises a connector element located within the projection, the connector element having a permitted degree of freedom of movement, comprising a base and an upstanding web, the web being engaged by two parallel ribs formed within the recess, the engagement between the web and the ribs defining the direction of the permitted movement of the connector element.

Advantageously, the connector element is provided with means adapted to retain the connector element within the projection.

Conveniently, the means adapted to retain the connector element within the recess comprises resilient arms provided with projections thereon, the projections engaging apertures provided in the recess.

Preferably, the bridge is formed of a principal molding defining at least one axially extending channel therein, there being a cover which is secured to the said molding on either side of the channel, thus defining a box-beam structure.

Advantageously, the molding defines two axially extending channels, the channels being separated by an axially extending partition, the cover being secured to the partition.

Preferably, the channel or each channel is provided with transversely extending webs.

Advantageously, the cover is provided with a recess which receives a mat of high friction material.

According to another aspect of this invention there is provided an exercise apparatus comprising an elongate bridge member, the bridge member having two depending edge regions to support the bridge member, the bridge member being formed of a principal molding defining at least one channel extending axially of the bridge, there being a cover secured to the molding on both sides of the channel, thus forming a box-beam structure.

Conveniently, two channels are provided extending axially of the bridge, there being a partition between the channels, the cover being secured to the molding at the outer edges of the channels and also being secured to the partition between the channels.

Preferably, the said channel or channels are provided with transverse reinforcing webs.

Conveniently, the bridge is provided with support elements adapted to support the bridge at different heights above the ground.

Advantageously, the support elements are adapted to support the bridge at three different heights above the ground.

Preferably, the connector means are provided to connect together the supports and the bridge, the connector means comprising connector projections provided on the supports and cooperating recesses provided on the bridge, each connector projection containing a connector element, each connector element comprising a base and a central upstanding web, the web being guided by spaced apart parallel ribs formed within the projection, the connector element further presenting two resilient arms each carrying a cam head located to extend through apertures formed in the side of the projection, the connector element presenting two opposed retaining arms, each comprising a resilient arm carrying an outwardly directed projection, the said projections being received within apertures formed in the projection to retain the connector element within the projection while permitting axial movement thereof, each recess defined by the bridge being dimensioned to receive the said projection on the support and presenting surface areas adapted to be engaged by the cam heads of the connector element.

Advantageously, the under surfaces of the cam heads are inclined and the surfaces engaged by the cam heads are similarly inclined so that a significant downward force may separate the support from the bridge.

According to another aspect of this invention there is provided a connector arrangement for interconnecting two parts, the connector arrangement comprising a projection on one part containing a connector element, and a cooperating aperture or recess on the other part, the connector element comprising a base carrying a first pair of resilient arms and a second pair of resilient arms, the first pair of arms being diametrically opposed and carrying, at their free ends, outwardly directed cam heads, the second pair of arms comprising locating arms and also being diametrically opposed, being further located on a line extending transversely to the axis defined by the first pair of resilient arms, the locating arms each having, adjacent their free end, outwardly directed engaging means, the said projection receiving the said connector element, the locating arms extending into apertures or recesses provided for that purpose, with the engaging means engaging a surface to prevent the connector element being moved from the recess, the first pair of arms carrying the cam heads projecting through apertures formed in the projection for that purpose, the cam heads being adapted to engage surfaces defined in the recess, the connector being movable, relative to the projection, along said axis.

Preferably, the base has a central axially extending upstanding web in alignment with said axis, the web being received between guide means formed within the projection to guide movement of the connector along said axis.

Advantageously, the guide means comprise parallel spaced apart ribs formed within the projection.

BRIEF DESCRIPTION OF THE DRAWINGS

In order that the invention may be more readily understood, and so that further features thereof may be appreciated, the invention will now be described, by way of example, with reference to the accompanying drawings in which:

FIG. 3 is a perspective view corresponding to FIGS. 1 and 2 showing the apparatus in a further alternate condition;

FIG. 4 is an exploded perspective view of one end of the bridge of the apparatus of FIGS. 1–3;

DETAILED DESCRIPTION OF PREFERRED EMBODIMENTS

Figure 1:
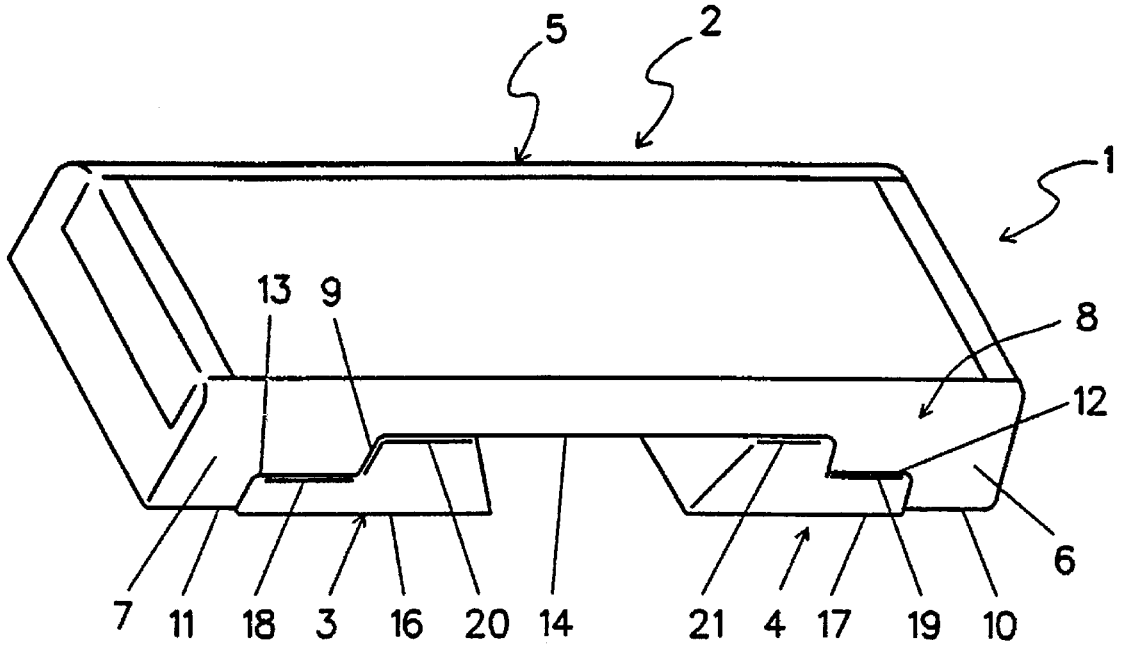
FIG. 1 is a perspective view of an exercise apparatus for use when carrying out a stepping exercise, the apparatus being shown in one condition.
Figure 2:
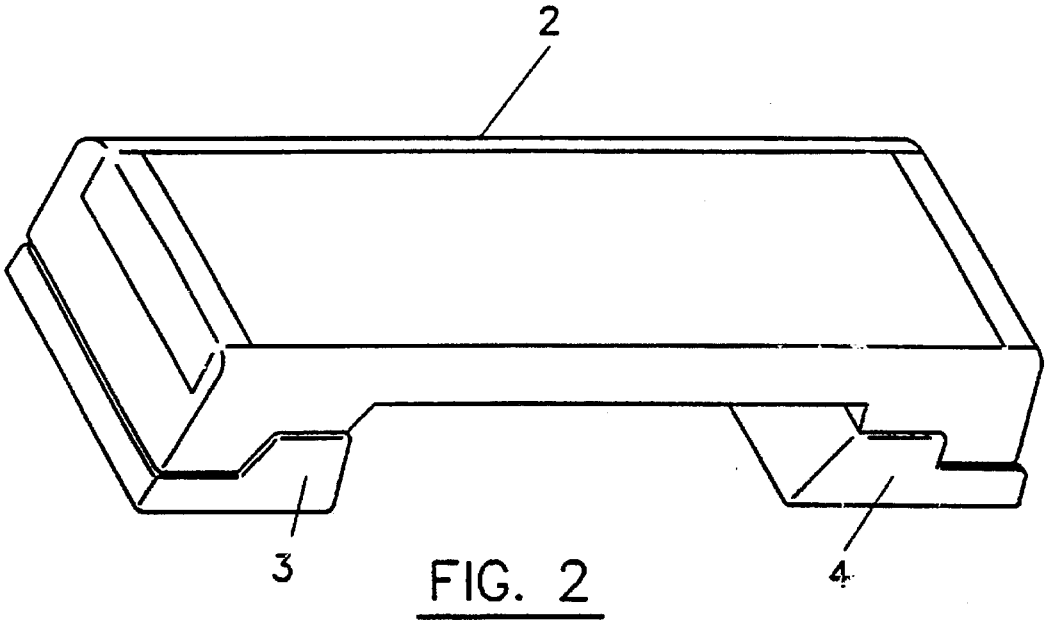
FIG. 2 is a perspective view corresponding to FIG. 1 showing the apparatus in an alternate condition.

Referring initially to FIGS. 1–3, an exercise apparatus 1 is illustrated, which consists of three principal elements, namely a bridge 2 and two bridge supports 3, 4. The bridge and the bridge supports are fabricated principally of molded plastics material elements.

The bridge 2 consists of a principal central portion 5 adapted to extend horizontally, the principal central portion 5 having, at each end, a depending portion 6, 7. The depending portions are provided with stepped under surfaces 8, 9 extending in towards the central region of the bridge. Thus, each depending portion 6, 7 has a terminal region 10, 11 which in the orientation of FIG. 1 may rest upon the floor, and a further upper region 14 which is located at a greater distance above the floor and which extends across the remaining width of the bridge 2.

Each bridge support 3, 4 has a base portion 16, 17 adapted to engage the floor and an upper surface divided into two parts, namely a lower part 18, 19 and an upper part 20, 21.

In the condition of the components of the apparatus as shown in FIG. 1, the supports 3, 4 are located underneath the bridge element 5 and the terminal regions 10, 11 of the depending end portions of the bridge 2 are in contact with the ground. The bases 16, 17 of the supports 3, 4 are also in contact with the ground. The lower parts 18, 19 of the upper surface supports 3, 4 engage the intermediate regions 12, 13 of the under surface of the bridge and the upper parts 20, 21 of the upper surfaces of the supports 3 and 4 contact the upper region 14 of the under surface of the bridge.

The components of the apparatus of FIG. 1 may be relocated, relative to one another, so that the step 2 is in an elevated position. This alternate condition of the components is illustrated in FIG. 2. It can be seen that in order to move the components from the position illustrated in FIG. 1 to the position illustrated in FIG. 2, effectively the bridge 2 is lifted and the bridge support components 3 and 4 are moved outwardly. The end result is that the terminal regions 10, 11 on the depending end portions 6, 7 of the bridge 2 now rest on the lower parts 18, 19 of the upper surface of the supports 3 and 4. The intermediate regions 12 and 13 of the under surface of the bridge rest on the upper parts 20, 21 of the upper surfaces of the supports 3 and 4. The bridge 2 is thus at an elevated height.

The components may be moved to a further alternate condition, as shown in FIG. 3, in which the bridge is at an even greater height. In order to move the components from the condition illustrated in FIG. 2 to the condition illustrated in FIG. 3, the bridge 2 is lifted and the supports 3 and 4 are moved outwardly and are rotated through 180°. Thus, in this condition of the apparatus the terminal regions 10, 11 of the depending terminal portions 6 and 7 of the bridge 2 rest on the upper parts 20, 21 of the upper surfaces of the supports 3 and 4. The supports 3 and 4 are, however, located so that the lower parts 18, 19 of the upper surfaces thereof are located under the bridge 2 instead of projecting out beyond the ends of the bridge. This facilitates exercises where it is desired to step on to the bridge from the end, rather than stepping on to the bridge from the side.

It will be appreciated from the foregoing description that the illustrated apparatus comprises three essential components which can be arranged in a straightforward manner to provide an exercise apparatus which presents a surface which can be used for a stepping exercise (that surface comprising the top of the bridge 2), the surface being readily located at three different heights above the ground or floor on which the apparatus is used. The apparatus is designed to be light and strong.

The bridge 2 must be capable of withstanding significant forces. It is intended that people will step on to the bridge 2 and off from the bridge 2, and may even jump on to and off from the bridge. Thus, the bridge must be made to be strong enough to withstand the forces applied to it during ordinary usage.

As can be seen from FIG. 4, which is an exploded view of the end part of the bridge 2, the bridge is formed of two principal components and an insert.

Thus, referring to FIG. 4, the principal component forming the bridge 2 is an injection molding 30 of an appropriate plastics material. The molding 30 defines an open recess 31 adapted to receive a cover 32. As will be described hereinafter, the cover 32 will be welded in position. The cover 32 defines a recess 33 in its upper surface adapted to receive an insert in the form of a mat 34 which presents high friction properties.

As can be seen from FIG. 4, the molding 30 forms the main part of the bridge 2, defining the under regions 10, 12 and 14 of the under surface as described above. It can be seen that the open recess 31 adapted to receive the cover extends axially along the top 5 of the bridge 2 and partway down the end wall 35. Within the recess 31 the molding defines two axially extending channels 36, 37 separated by an upstanding central partition which presents a substantially planar upper wall 38. A plurality of transverse webs 39 extend across the channels 36 and 37.

The cover 32 has a substantially planar central portion 40 adapted to be co-aligned with the upper surface of the central portion 5 of the bridge 2 and a depending terminal portion 41 adapted to be co-aligned with the end wall 35 of the bridge 2. The cover 32 is dimensioned so that when it is located within the recess 31, the cover 32 contacts the top of the central partition 38, and also contacts the main molding 30 at the sides of the two channels 36 and 37. The cover 32 is ultrasonically welded in position, the cover being welded to the periphery of the open recess 31 and also being welded to the top of the central partition 38.

Figure 4A:
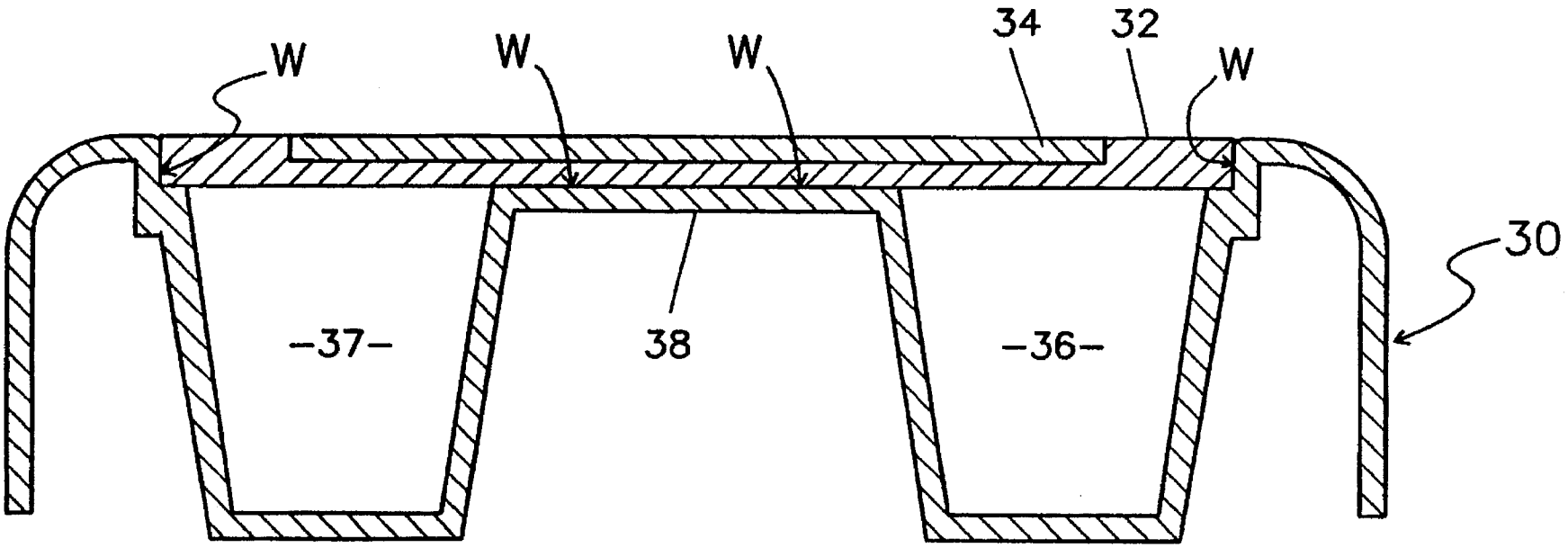
FIG. 4A is a cross-sectional view of the bridge of the apparatus of FIGS. 1–3.

Referring to FIG. 4A, the cover 32 can be seen to be welded in position on the molding 30. Welds are provided in the regions indicated by the arrows W.

The combination of the cover and the portions of the molding 30 which define the channels 36 and 37 thus combine to form two box sections which extend axially of the bridge 2 from one end thereof to the other. These box sections, together with the transverse reinforcing web 39, provide the bridge with sufficient strength to withstand the forces applied to the bridge during ordinary usage of the exercise apparatus.

The insert 34 may be formed of any appropriate material, such as a rubber-based material, and the upper surface of the insert 34 may carry small protrusions to assist in providing adequate grip. The insert 34 may carry advertising material.

Figure 5:
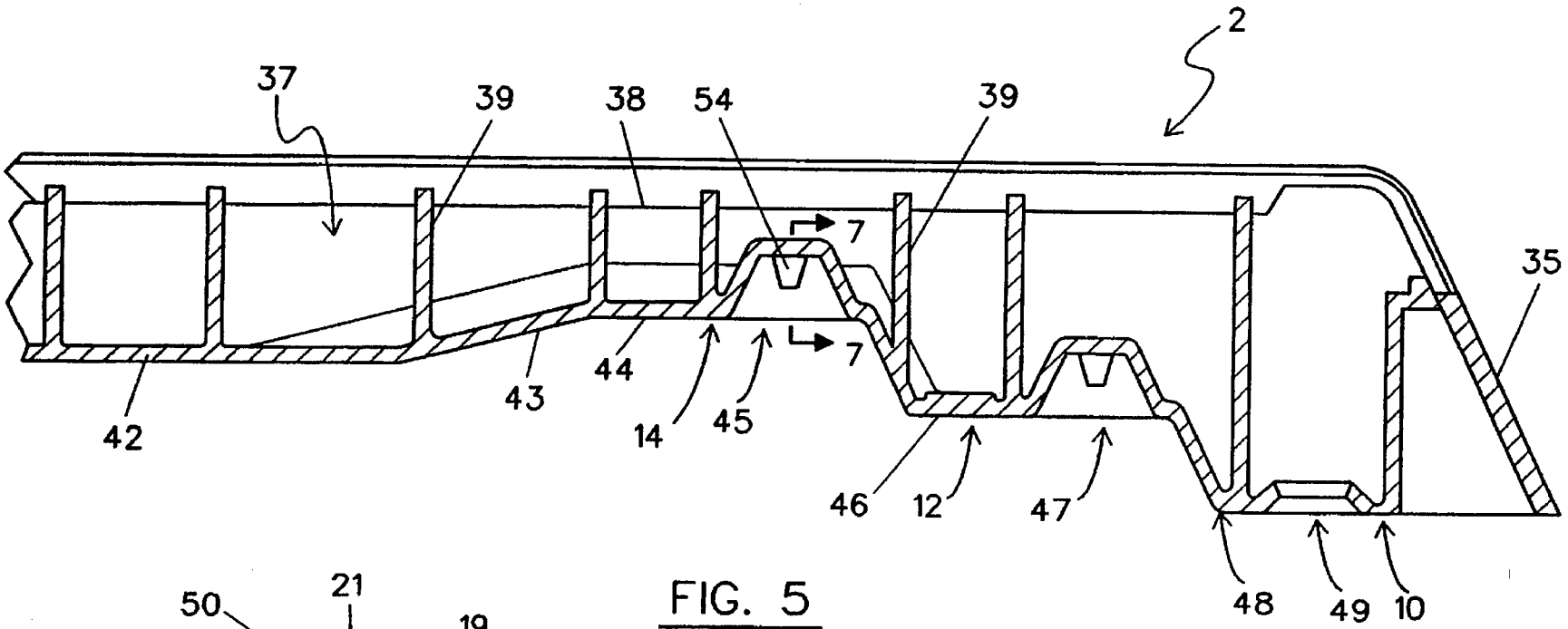
FIG. 5 is a cross-sectional view of the end of the bridge, as shown in FIG. 4, with the cover removed.

FIG. 5 is a cross-sectional view illustrating the end of the bridge 2. It can be seen that the base of the channel 37 does not extend horizontally over the entire length of the channel. In the central part of the bridge, the base 42 of the channel 37 extends horizontally at a predetermined level, but towards the end of the bridge the base of the channel inclines upwardly 43 to terminate at a higher level 44 which is equivalent to the upper region 14 illustrated in FIG. 1. It is to be appreciated that the channels 36 and 37 are substantially centrally located within the bridge 2 and are thus not visible in FIGS. 1–3. The horizontal portion 44 is provided with an upwardly extending downwardly open recess 45, which comprises a connector recess adapted to cooperate with a connector provided on the support 4 in order to connect together the support and the bridge.

The base of the channel 37 then drops to a lower level 46, where a further connector recess 47 is provided. This is equivalent to the intermediate region 12 of FIG. 1. The base of the channel then drops to a final lowermost level 48 where an upwardly open aperture 49 is provided, this being at a level corresponding to the terminal region 10 of FIG. 1.

Figure 6:
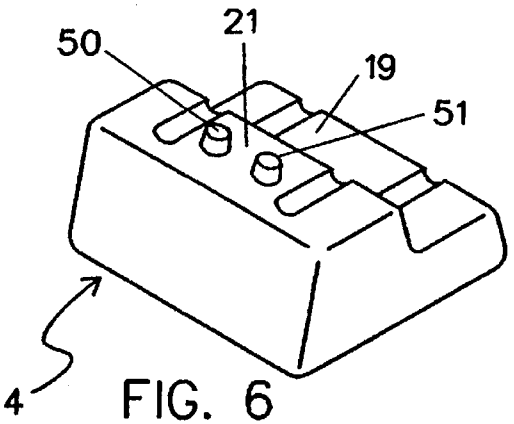
FIG. 6 is a perspective view of a support as shown in FIGS. 1–3.

FIG. 6 is a perspective view illustrating the support 4 illustrating the lower upper surface portion 19 and the upper upper surface portion 21. It is to be observed that the upper upper surface portion 21 is provided with two identical connector projections 50, 51, these projections being located at positions where they can be inserted in the connector recesses 45, 47 or through the connector aperture 49 when the components of the apparatus are in the various alternate positions illustrated in FIGS. 1–3.

Figure 7:
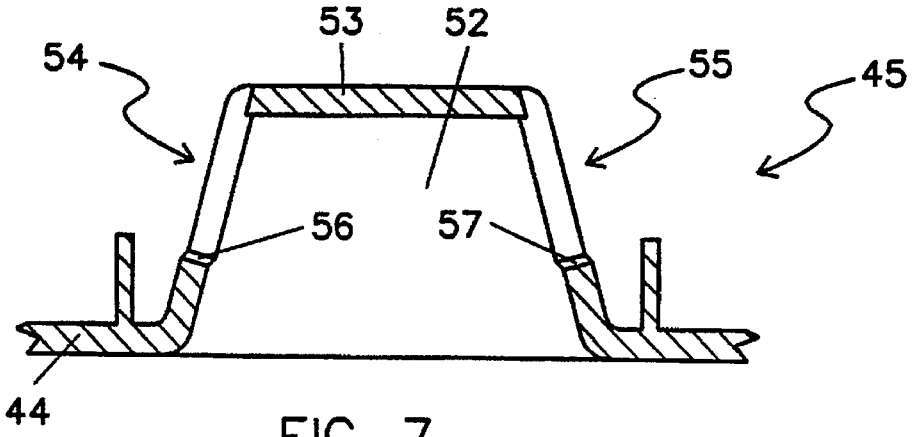
FIG. 7 is a cross-sectional view of a connector recess as present on the bridge, taken on the line 7–7 of FIG. 5.

FIG. 7 is a cross-sectional view of the connector recess 45 taken on the line 7—7 of FIG. 5, which is identical to the connector recess 47.

As can be seen from FIG. 7, the recess 45 effectively comprises an upwardly directed dome-shaped portion comprising a frustoconical side wall 52 and a substantially planar top 53. Two diametrically opposed apertures 54, 55 are formed in the side wall. The apertures, as can be seen from FIG. 5, are of substantially rectangular form. However, as can be seen most clearly from FIG. 7, the lower edges 56, 57 of the apertures 54, 55 in the side walls incline inwardly at an angle to the horizontal. As will be described hereinafter in greater detail, a connector projection containing a connector element is intended to be inserted into the projection 45 from below, and the connector element will engage the lower edges 56 and 57 of the apertures 54 and 55.

The recesses 45 and 47 operates in the same way as the connector aperture 49. The recesses 45 and 47, however, have greater mechanical strength and is provided at positions where it is expected that the bridge will be subjected to stress.

Figure 8:
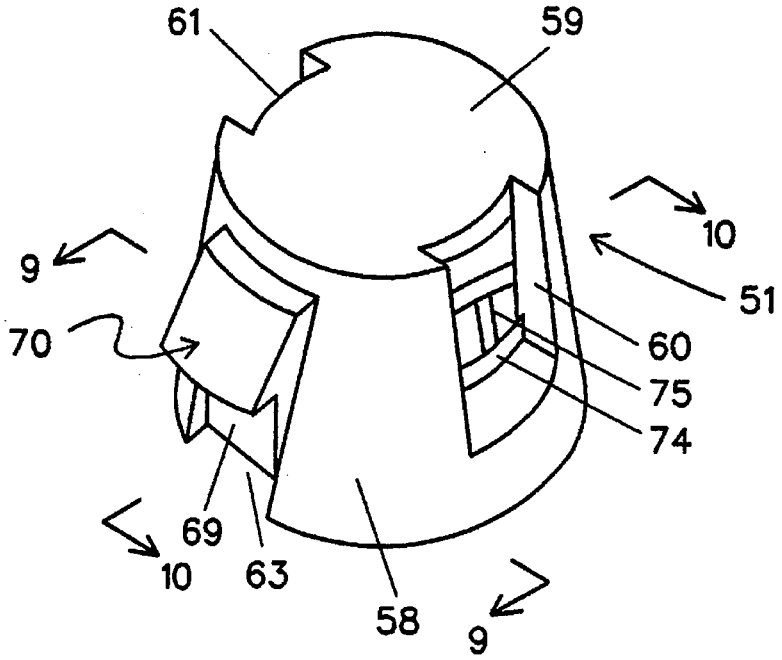
FIG. 8 is a perspective view of a connector projection as present on the support of FIG. 6, with a connector element in position.
Figure 9:
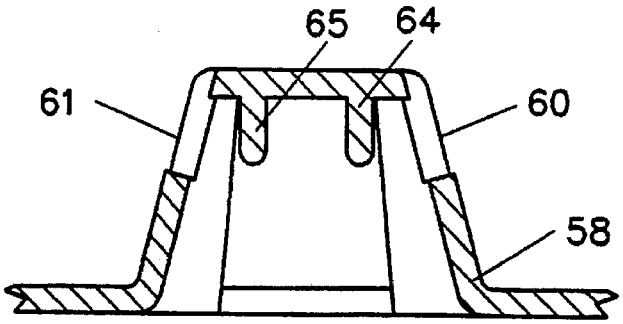
FIG. 9 is a cross-sectional view of the projection of FIG. 8 taken on the line 9—9.
Figure 10:
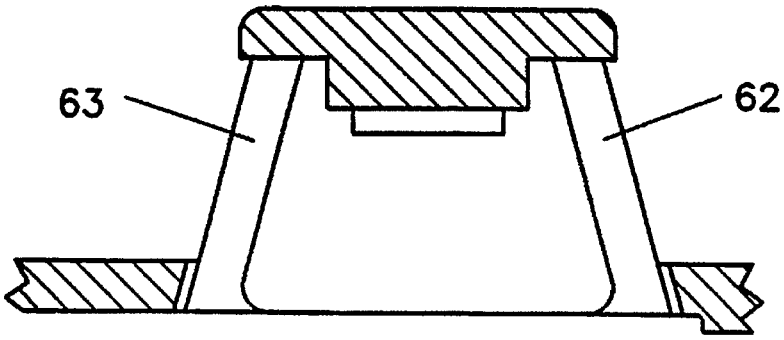
FIG. 10 is a cross-sectional view of the projection of FIG. 8 taken on the line 10—10.

Referring now to FIGS. 8–10, the connector projection 51 is illustrated. This projection extends upwardly from the support 4 and is also formed as a dome-shaped projection having a frustoconical side wall 58 and a substantially planar circular top 59. The dimensions of the side wall 58 and the top 59 are such that the projection 51 may be inserted into the recess 45 from beneath, or into the aperture 49 from beneath.

The projection 51 defines two pairs of apertures in the frustoconical side wall 58. The first pair of apertures 60, 61 are diametrically opposed and have a predetermined height. The apertures extend into part of the circular top 59 and are of substantially rectangular form. The second pair of apertures 62, 63 are also diametrically opposed, being located on an orthagonal axis to the axis containing the apertures 60 and 61. The apertures 62 and 63 do not extend into the top 59, but instead extend over substantially the entire vertical height of the frustoconical side wall 58.

As best shown in FIG. 9, two parallel spaced apart depending ribs 64, 65 are provided which extend downwardly from the under surface of the top 59 of the projection. The ribs are aligned with the axis on which the apertures 62 and 63 lie.

A connector element 66 (shown in FIG. 11) is adapted to be mounted within the connector projection 51. The element 66 is molded integrally of plastics material and comprises a substantially rectangular base 67. An axially extending upstanding planar web 68 is provided located centrally of the base 67 and extending over substantially the entire length of the base. At the narrow ends of the base respective upstanding resilient arms 69 are provided. The arms 69 each end with a cam head 70 which is outwardly directed. As can be seen most clearly from FIG. 12, which is an enlarged sectional view of the cam head 70, the cam head presents an upward inclined under surface 71 and an inclined upper surface 72. From each side of the base 67 a resilient locator arm 73 is provided. Each locator arm carries, towards its upper end, an outwardly directed protrusion 74 which is provided with a triangular reinforcing web 75 located above the protrusion 74.

Figure 11:
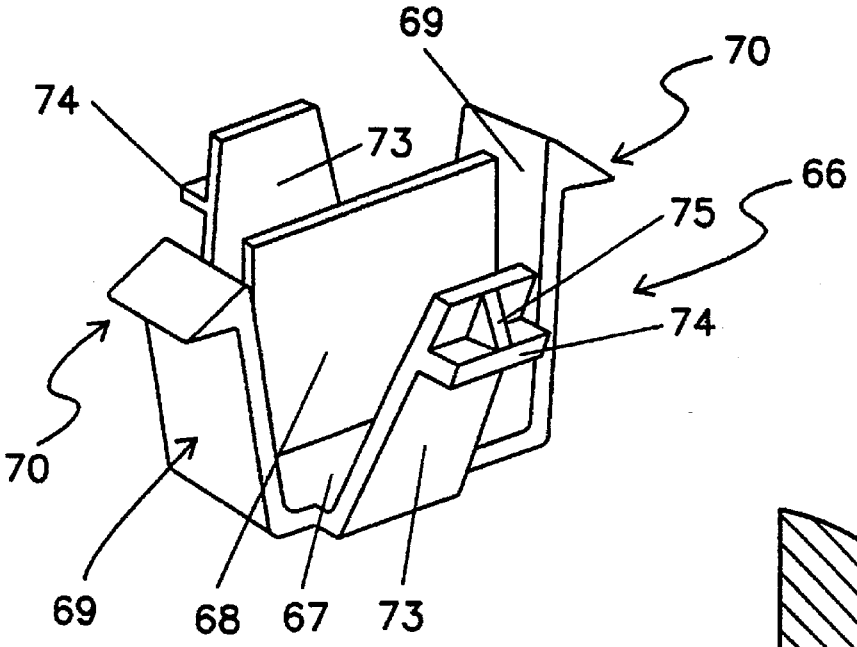
FIG. 11 is a perspective view of a connector element to be received within the connector projection of FIGS. 8–10.
Figure 12:
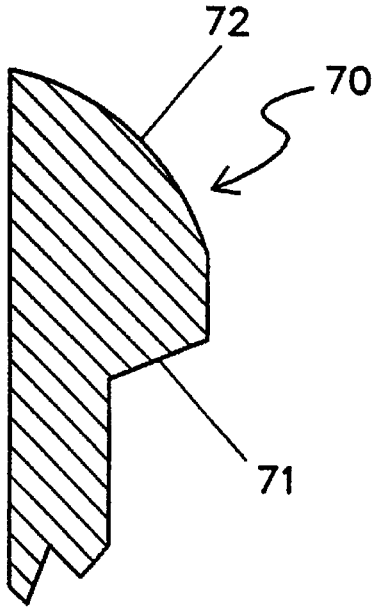
FIG. 12 is an enlarged view of a cam head present on the connector element of FIG. 11.

The connector element 66 of FIG. 11 is intended to be inserted, from beneath, into the projection 51, as illustrated in FIG. 8. The arms 69 carrying the cam heads 70 are co-aligned with the apertures 62, 63, which means that the locator arms 73 are co-aligned with the apertures 60, 61. The connector element is pushed upwardly into the projection 51 from beneath. The inner surface of the frustoconical wall 58 drives the resilient locator arm 73 inwardly until the protrusions 74 are aligned with the lower parts of the apertures 60, 61. The arms then spring resiliently outwardly. The protrusions 74 on the arms 73 then engage the lower parts of the apertures 60, 61 preventing the connector from moving downwardly out of the projection 51. The web 68 is then located between the downwardly extending ribs 64, 65. The dimensions of the components are such that the connector element may move slightly in the direction of the axis defined by the web 68.

The cam heads 70 projects out of the relatively large apertures 62, 63 due to the resilient bias provided by the arms 69.

When the components of the apparatus are located in the position illustrated in FIG. 1 of the drawings, the projection 51 is inserted into the recess 45. The apertures 62, 63 of the projection 51 are aligned with the apertures 54, 55 of the recess. As the projection 51 is moved into the recess, initially the inner surfaces of the frustoconical side wall 52 of the recess 45 engage the upper inclined cam faces 72 on the cam head 70, thus tending to urge the cam head 70 inwards against the bias of the resilient supporting arm 69. However, when the cam head 70 is aligned with the aperture 54 or 55 in the recess 45, the resilient forces provided by each arm 69 forces the cam heads 70 outwardly, so that the cam heads are effectively located within the aperture 54 or 55. The inclined under surface 71 of each cam head 70 engages the inclined face 56, 57 forming the lowermost edge of the aperture 54 or 55. Since the cam heads 70 engage both of the apertures 54, 55, the cam heads resist any downward movement. Since the connector 66 is securely mounted within the projection 51, by virtue of engagement of the projection 74 and the lower parts of the apertures 60, 61, there is, effectively, a secure connection between the bridge and the support.

It is to be noted that on the support 4 there are two identical projections 50, 51. As the projection 51 is being engaged with the recess 45, as described, the projection 50 will be engaging a corresponding recess. The distance between the projections 50, 51 may vary due to molding conditions present when the support 4 is being molded, and similarly the distance between the recesses formed on the bridge 2 may vary due to conditions existing when the bridge is molded. It is to be noted that each connector member 66 can move slightly in the direction defined by the web 68, which is a direction transverse to the longitudinal axis of the bridge. Thus, the connector elements may position themselves appropriately to absorb any slight discrepancies of positioning that exist.

Because the under surface 71 of the cam head 70 is inclined upwardly, and because the surfaces 56, 57 which form the lower boundaries of the apertures 54 and 55 are inclined, when the support 4 is to be separated from the bridge it be readily separated by exerting a significant downward force. Because the cam heads all lie on an axis which extends transversely across the width of the bridge, it is possible to exert a sideways levering action on the support 4, by grasping one side edge of the support 4 and effecting a levering movement about a pivot axis defined by the uppermost part of the other side of the support 4, thus readily disengaging the cam heads 70 from the apertures 54 and 55.

It is to be understood that if the projection 50 is inserted into the aperture 49 the cam heads 70 of the connector element within the projection 50 will engage the top edge of the aperture 49, the edge of the aperture 49 operating in the same way as the surfaces 56 and 57.

While the connector arrangement of FIGS. 7–12 has been described with reference to an exercise apparatus in the form of a step, it is to be appreciated that the connector arrangement may find many alternate applications where two components are to be releasably connected together.

While the invention has been described with reference to one embodiment, it is to be appreciated that many modifications and alterations may be effected without departing from the scope of the invention as defined by the following claims. For example, the bridge may comprise a principal molding that defines only one elongate channel, or a molding that defines three or more elongate channels.

What is claimed is:

1. An exercise apparatus, comprising:

a bridge, the bridge being of elongate form and having two end regions, and two support elements, each support element being adapted to engage a respective end region of the bridge, the bridge and the support elements being so configured that lateral translation of the support elements causes the support elements to engage the bridge in different relative positions, thus supporting the bridge at different heights, wherein each support element comprises means defining a base to engage the ground and an upper surface having a lower portion and an upper portion, each end of the bridge having an under surface defining at least two levels which are spaced apart vertically, and adapted selectively to engage said portions of the upper surface of the support element.

2. An apparatus according to claim 1, further comprising:

connector means for releasably connecting each support to the bridge, the connector means being located on the uppermost part of the upper surface of each support.

3. An exercise apparatus, comprising:

a bridge, the bridge being of elongate form and having two end regions, and two support elements, each support element being adapted to engage a respective end region of the bridge, the bridge and the support elements being so configured that the support elements can engage the bridge in different relative positions, thus supporting the bridge at different heights;

wherein each support element comprises means defining a base to engage the ground and an upper surface having a lower portion and an upper portion, each end of the bridge having an under surface defining at least two levels which are spaced apart vertically, and adapted selectively to engage said portions of the upper surface of the support element; and further comprising connector means for releasably connecting each support to the bridge, the connector means being located on the uppermost part of the upper surface of each support; and wherein the connector means comprises cooperating elements present on the bridge and on the support, the elements on the support comprising projections, each projection having connector means adapted to engage cooperating surfaces provided on the bridge.

4. An apparatus according to claim 3, wherein:

the cooperating surfaces on the bridge comprise inclined surfaces which form boundaries for apertures formed in a recess formed in the under surface of the bridge.

5. An apparatus according to claim 3, wherein:

each connector means comprises a connector element located within the projection, the connector element having a permitted degree of freedom of movement, comprising a base and an upstanding web, the web being engaged by two parallel ribs formed within the recess, the engagement between the web and the ribs defining the direction of the permitted movement of the connector element.

6. An apparatus according to claim 5, wherein:

the connector element is provided with means adapted to retain the connector element within the projection.

7. An apparatus according to claim 6, wherein:

the means adapted to retain the connector element within the recess comprises resilient arms provided with projections thereon, the projections engaging apertures provided in the recess.

8. An apparatus according to claim 7, wherein:

the bridge is formed of a principal molding defining at least one axially extending channel therein, there being a cover which is secured to the said molding on either side of the channel, thus defining a box-beam structure.

9. An apparatus according to claim 8, wherein:

the molding defines two axially extending channels, the channels being separated by an axially extending partition, the cover being secured to the partition.

10. An apparatus according to claim 9, wherein:

each channel is provided with transversely extending webs.

11. An apparatus according to claim 10, wherein:

the cover is provided with a recess which receives a mat of high friction material.

12. An apparatus comprising:

an elongate bridge, the bridge having two depending edge regions to support the bridge, the bridge being formed of a principal molding defining at least one channel extending axially of the bridge, there being a cover secured to the molding on both sides of the channel thereby forming a box-beam structure; and further comprising connector means to connect together the supports and the bridge, the connector means comprising connector projections provided on the supports and cooperating recesses provided on the bridge, each connector projection containing a connector element, each connector element comprising a base and a central upstanding web, the web being guided by spaced apart parallel ribs formed within the projection, the connector element further presenting two resilient arms each carrying a cam head located to extend through apertures formed in the side of the projection, the connector element presenting two opposed retaining arms, each comprising a resilient arm carrying an outwardly directed projection, said projections being received within apertures formed in the projection to retain the connector element within the projection while permitting axial movement thereof, said recesses defined by the bridge being dimensioned to receive said projection on the support and presenting surface areas adapted to be engaged by the cam heads of the connector element.

13. An apparatus according to claim 12, wherein:

the under surfaces of the cam heads are inclined and the surfaces engaged by the cam heads are similarly inclined so that a significant downward force may separate the support from the bridge.

* * * * *